US006260846B1

(12) United States Patent
Rudd

(10) Patent No.: US 6,260,846 B1
(45) **Date of Patent: *Jul. 17, 2001**

(54) METHODS OF PAYING WINNING BETS

(76) Inventor: Clarence Rudd, 8 Anzac Parade, Burleigh Heads, Queensland (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/296,596

(22) Filed: Apr. 23, 1999

(30) Foreign Application Priority Data

Dec. 4, 1998 (AU) ..... PP7516

(51) Int. Cl.[7] ..... A63B 71/00
(52) U.S. Cl. ..... 273/148 R; 463/17
(58) Field of Search ..... 273/138.1, 148 R, 273/460; 463/16, 17, 25

(56) References Cited

U.S. PATENT DOCUMENTS 4,130,871 * 12/1978 Olsen et al. ..... 273/148 R
4,193,600 * 3/1980 Armstrong et al. ..... 273/148 R
4,339,134 * 7/1982 Macheel ..... 273/148 R
4,744,098 * 5/1988 Grabowski ..... 273/148 R
5,159,549 * 10/1992 Hallman, Jr. et al. ..... 273/148 R
5,265,009 * 11/1993 Colavita ..... 273/148 R

FOREIGN PATENT DOCUMENTS 0 599 769 A2 6/1994 (EP) .
WO 95/30944 11/1995 (WO) .

* cited by examiner

*Primary Examiner*—Sam Rimell
(74) *Attorney, Agent, or Firm*—Oblon, Spivak, McClelland, Maier & Neustadt, P.C.

(57) ABSTRACT

This invention provides a method of paying winning bets against the house in a casino game such as Roulette. According to this method the casino provides a player's VDU display to display those bets of a player which are normally combined mentally by a croupier to provide a payout but which instead are entered through a keyboard or the like of data-input means by a croupier to provide an automatic calculation of the player's winnings. The player's VDU display also displays the total payout which is computed as being the amount payable to the player. In addition the data-input means has a display which the croupier can read without taking their attention from the table. This display enables the croupier to check the accuracy of the amounts entered and the total payout while maintaining surveillance of the table to ensure that bets are not shifted after close of play. At the same time the players can readily check the player's VDU display to ensure their wins are paid correctly.

7 Claims, 4 Drawing Sheets

METHODS OF PAYING WINNING BETS

THIS INVENTION relates to methods of paying winning bets against the house in a game of chance or a gambling activity and a payout calculation aid suitable for such methods.

In particular this invention is directed to a calculator which may be used in a game of chance or a gambling activity to assist in determining the value of a winning bet.

Reference will be made hereinafter to the game of roulette by way example, however such reference is not to be understood as limiting the invention to the game of roulette as the present invention may also be applied to other casino games or situations where it is necessary to undertake mathematical computations to determine winnings where bets are placed at various odds.

In a game of roulette there may be a number of players bets on the table differentiated only by the colours of their playing chips. Some players may also be betting with cash chips which do not have an indication of the player betting them Setting chips may be placed in various locations on the table to signify the particular bet including the payout odds.

Prior to the close of bets on the spin of a roulette wheel, any single player can place bets on a number of stations designating one or more numbers on the wheel. However the croupier must be very vigilant to ensure that chips are not shifted after close of bets and before winning bets are paid. This necessitates that the croupier does not shift his attention away from the placed bets.

When paying winning bets the croupier will first pay the even chance bets, odds 1:1, and the double chance bets, odds 2:1. These are paid by distribution of the matching chips and being either the same quantity as placed or double the number, depending on the odds for the stations at which the bets are placed. The players themselves recover these chips from the table. Such low odds stations are typically arranged about the periphery of the table and may be referred to hereinafter as peripheral bets.

Subsequently the more complicated bets where each winning player may have chips arranged at different stations signifying different payout odds are calculated and paid sequentially to each winning player. Typically the player's bet furtherest from the croupier is paid first as that player is the most difficult to monitor to ensure that their chips are not manipulated after the close of bets.

To effect a payout the croupier must perform a summation of totals arrived at by counting the number and/or value of chips at each respective station and multiplying that number and/or value by the odds for that station. At present this calculation is performed mentally by the croupier and as a result the calculation is subject to errors and challenges from players. Any such challenge stops further play until the matter has been cleared and this slows down the rate of play of games with obvious detrimental effects.

Furthermore, if the computation is disputed, there is no physical record of that computation to resolve any alleged discrepancy As the odds may be 35:1, 17:1, 11:1, 8:1, 6:1, or 5:1 the calculation can be relatively complex In addition, management or other staff of the casino or similar gambling venue may not have any record upon which to settle a dispute which may arise over a payout This invention aims to alleviate at least one of the abovementioned disadvantages and to provide a method of paying winning bets and/or aid for this purpose.

With the foregoing in view, this invention in one aspect resides broadly in a method of paying winning bets against the house in a game of chance in which a player can have several bets at different odds, including providing a player's display for displaying to the players the bets of a player including the total of each bet and its respective odds and the total payout to be returned to the player, providing house input means for inputting a player designation, the total bet and its odds per winning bet and providing a further display at the input means for displaying the input values and the total payout to be paid to the designated player, whereby a house operative may input and check the input values and read the payout without the house operative diverting their attention from the bets; and providing computation means linking the input means with the player's display whereby upon the entering each respective winning bet the calculation of the total payout is performed and automatically displayed on the player's display and at the house input means whereby the house may pay the win, and wherein the win is displayed on the player's display for checking by the winning player.

if desired the players display and/or Me house input means may also display the sub-totals for each winning bet which sum to the total payout for the win.

This method may be used for effecting winning payouts in such games as roulette or other casino type game in which multiple bets at different odds are permitted.

Preferably for the game of roulette the method includes:

paying peripheral bets by returning winning chips direct to the peripheral stations;

providing a player's display for displaying to the players the bets of a player induding the total number of chips played per winning station, the payout odds per winning station, and the total payout in chips and/or dollar value thereof to be returned to the player;

providing house input means for inputting the total number or value of chips played per each respective winning station, and providing a further display at the house input means for displaying the input values in a recognisable manner and the total winning payout in chips and/or dollar value thereof to be returned to the player, and the house input means and its associated display being configured whereby a croupier may input and check the input values and read the payout without turning away from the table, and providing computation means linking the house input means with the player's display whereby, upon the croupier entering the number of chips or bet value for each respective winning station, the calculation of the win is performed and automatically displayed to the players. If desired the house input means and/or the players display may display the sub-totals for the respective winning stations which were summed to provide the total win. It is preferred that the house input means include designation means for designating the value of the chips of a respective player and suitably the house input means includes means for designating each player. Typically in the game of roulette the player designations are chip colours.

In another aspect this invention resides broadly in a payout calculation aid, including a data-input module for inputting bet totals against the bet odds for a winning bet; computation means for computing the winning bet input into the data-input module, and a display for displaying the win computed. It is preferred that the data input module include a display for displaying the winning bet to the croupier so that the croupier may effect a payout without first making a mental calculation of the win. However such mental computations may be retained and the computed win may be displayed only to the players as a means of checking win payouts.

In a typical embodiment of the invention the data input module includes:

numeric keys zero to nine for inputting the bet totals; a bet key corresponding to an allowable bet in a gambling activity for which said calculator is being used; a screen to display the values input against an allowable bet and to display the winning bet total.

The win may be displayed in monetary value or in chip or token numbers or the like when such are used in the gambling activity. The data-input module may also include at least an identification key which can function as a player identification key and which suitably enables a simplification of the information necessary to be input for each particular player.

For example where a player is playing with chips or tokens having a selected value the identification key may enable that information to be input for the player whose win is being computed. Suitably the data-input module also includes a key to clear the screen in readiness for the calculation of the winnings of the next player or punter.

For the game at roulette each bet key may have indicia indicating the bet station odds and/or the bet station designation such as for example, straight, split, street, comer, six line or first five. These designations can be displayed in the appropriate language of the country in which the calculator is being used. This and other keypad indicia may be tactile indicia so that a croupier or the like can identify the keys by feel. The keypad of the data input module may be fixed into the table and the display of the data input module may be remote from the keypad and mobile and/or hand held if desired so that the diversion of a players attention from the table is minimised.

In order that this invention may be more readily understood and put into practical effect, reference will now be made to the accompanying drawings which illustrate a typical embodiment of this invention adapted for the game of roulette, and wherein.

FIGS. 4*a* to 4*e* provide suitable algorithms for the computation means.

Figure 1:
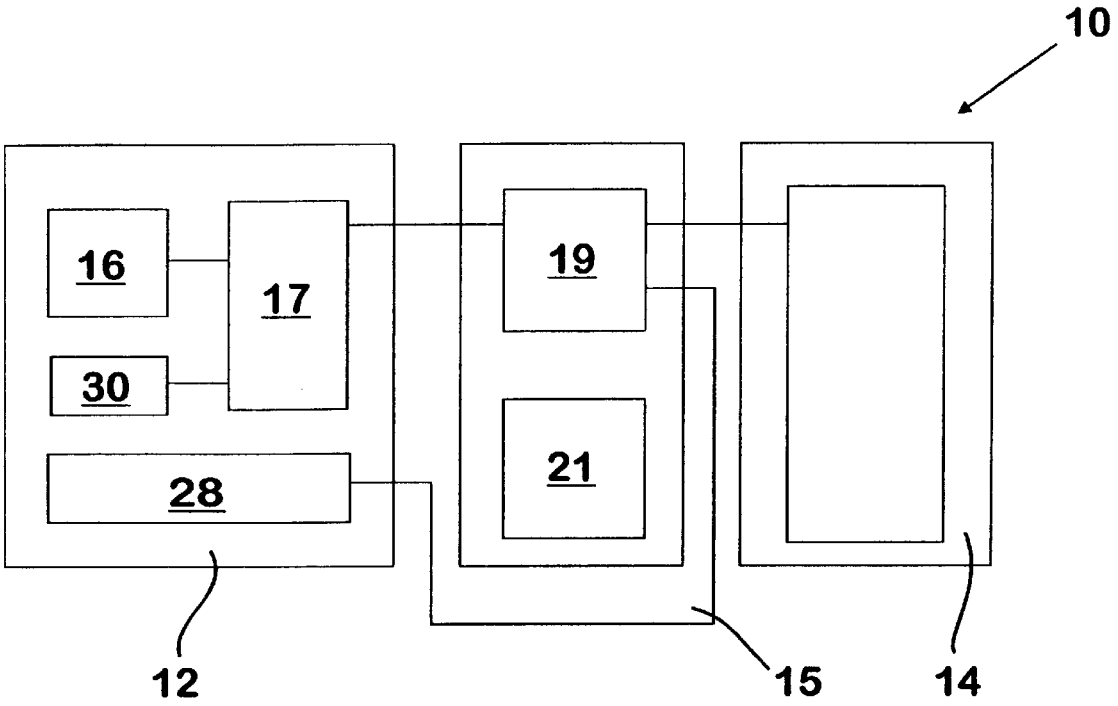
FIG. 1 is a schematic of the payout calculation aid.
Figure 2:
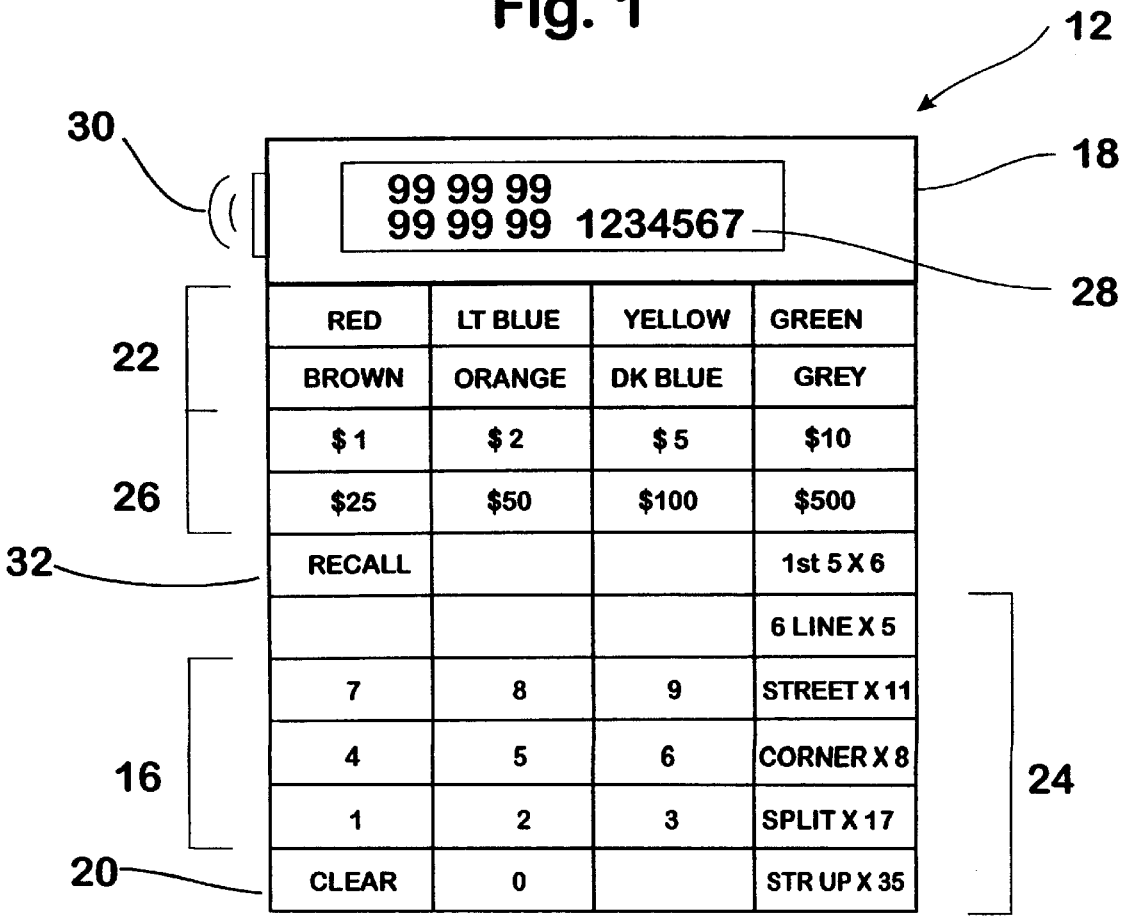
FIG. 2 is a schematic illustration of the face of a data-input module in accordance with the present invention.

The payout calculation aid 10 illustrated schematically in FIG. 1 comprises a data-input module 12, a remotely connected display module 14 and computation means 15 including a calculator 19 and a power supply 21. As illustrated in FIG. 2, the data-input module 12 has a housing 18 which accommodates a power on/off button, not illustrated, a numeric keypad 16 containing numeric keys for the entry values 0 to 9; a dear key 20 and an associated keypad interface 17 to the calculator 19; a row of seven player identification keys 22*a–g* which, in this embodiment, are colour coded to represent an individual player; six bet keys 24*a–f* which correspond to a bet in roulette and namely a straight, split, street, corner, six line and first five respectively; a further row of eight chip value buttons 26*a–h* each capable of representing a numerical value which as illustrated are $1, $2, $5, $10, $25, $50, $100 and $500 a screen 28; a buzzer 30; and a recall key 32.

If desired, the chip value keys 26 could have appropriate stickers to indicate the value and currency represented by each key, and this value may be programmable to suit the country of interest.

Figure 3:
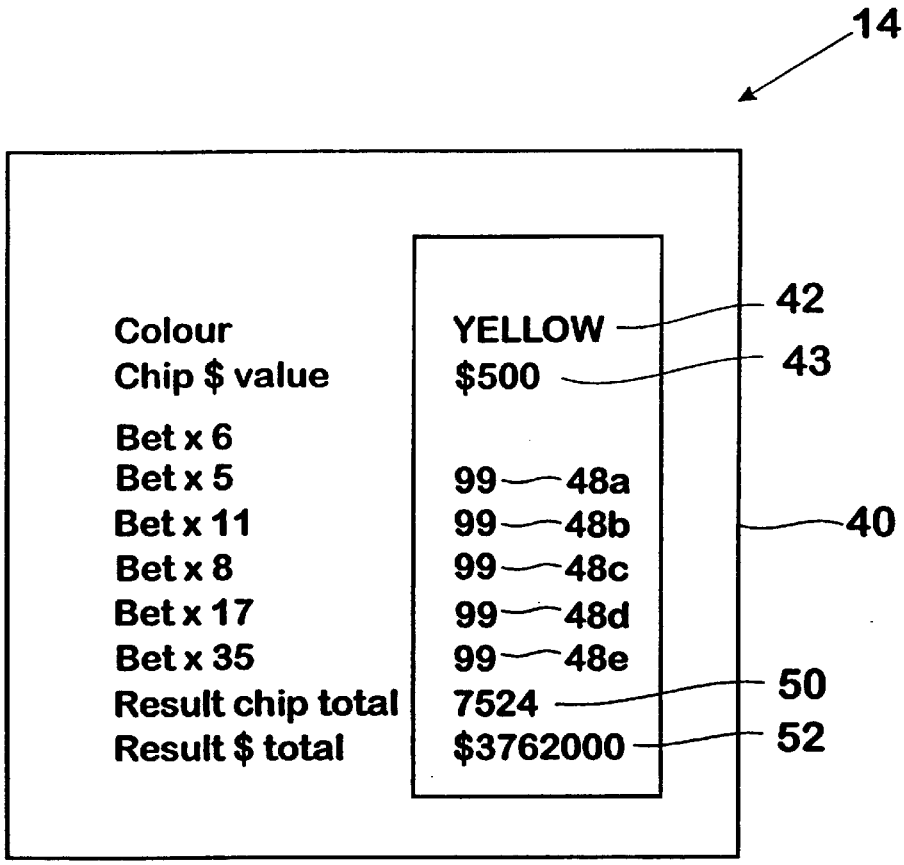
FIG. 3 is a schematic plan view of the face of the players display.

The data-input module 12 includes internal memory similar to a conventional calculator and can retain a sequence of data entry in order to compute and store the final computation, The display module 14 illustrated in FIG. 3 is of multi sided prismatic configuration with displays on the various sides and/or top if required. The displays are suitably video display units, Each of the side panels 40*a–c* and the top panel 40*d* may be adapted by any means known in the art to display an image transmitted to the display module 14. Each panel 40 is divided into segments. The segment 42 displays the colour or number assigned to the player whose payout is being determined and an associated segment 43 displays the designated chip value for that colour. This value may be input from the keypad 16 for each player/colour.

A further six sub-segments 44*a–f* each correspond to a bet in roulette paying particular odds and namely a straight, split, comer, street six line and first five. These segments provide the bet designation and the number of winning chips input through the data-input module for that for each bet A third segment 50 displays a running total of the number of winning chips determined for the player as the computation progresses. A fourth segment 52 displays the cash equivalent of the payout as a running total.

In this embodiment the computations are calculated as per the algorithms provided in FIG. 4 which dearly illustrate the chain of entry events and the ensuing calculations.

Figure 4A:
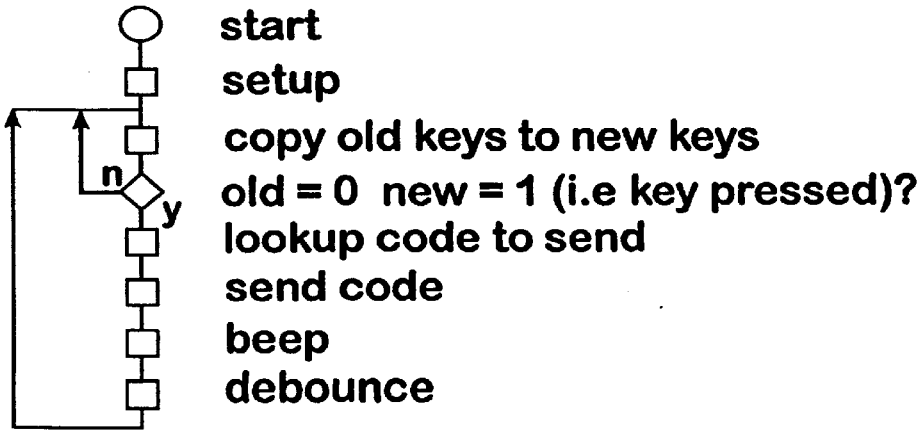

FIG. 4*a* provides the logic of the keypad entry algorithm from start of a calculation to clearing that calculation from the display and including provision for a recalculation process.

Figure 4B:
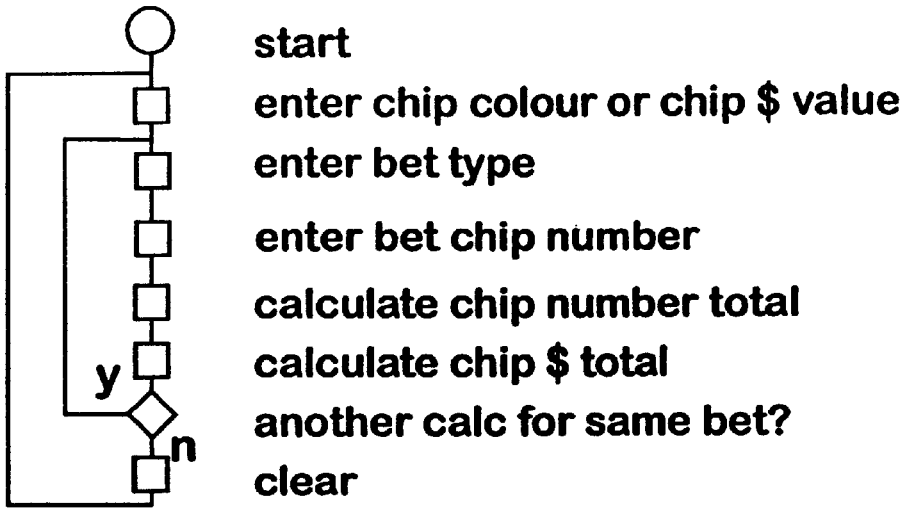
Figure 4C:
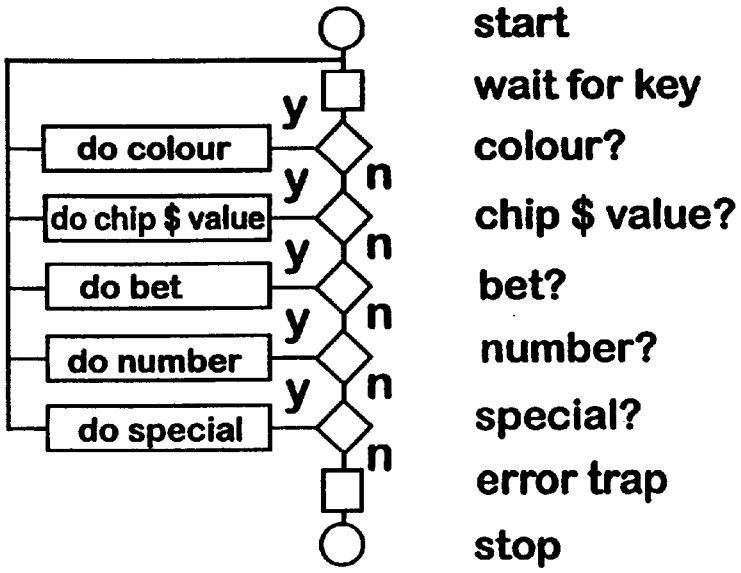
Figure 4D:
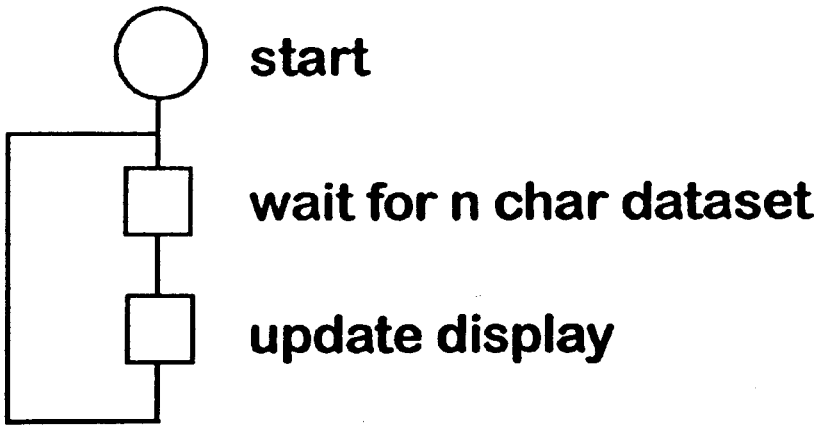
Figure 4E:
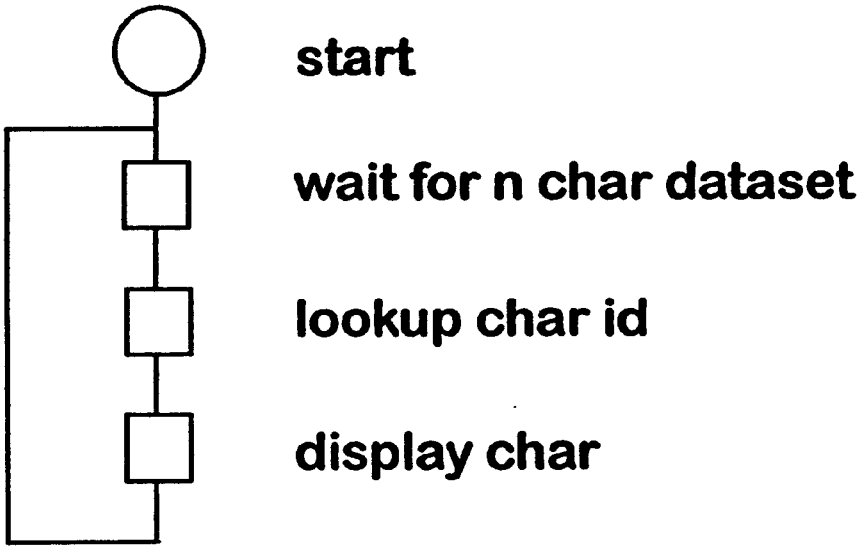

FIG. 4*b* provides the logic of the computations performed by the computation means which is suitably a programmable personal type computer, while FIGS. 4*c* and 4*d* provide the algorithms for the house display and the player's display.

In use, the calculator is first programmed to enable the players to be identified by colour and the value and denomination of the chips being played to be entered. To calculate each players winnings, other than simple 1:1 and 1:2 odds bets, the croupier proceeds as follows. In this example a player has been assigned yellow coloured chips which have been designated as $500 chips and the player has 99 chips on all six possible betting odds/stations.

As each key is pressed, the buzzer 30 provides the audible confirmation of entry of that key stroke so that the croupiers attention is not diverted from the table. The croupier first presses the appropriate player identification key 22*c*. The colour and/or number assigned to that player is displayed in the segment 42 of the player's display module 14 as is the chip value selected by pressing the key 26*h*. The croupier then presses the bet key 24*a* for the 5:1 station an enters the number of chips that the player has on that bet by pressing the appropriate numeric keys 16. The number of chips thus entered is displayed in the subsegment 48*a* of the display module 14 and also on the screen 28 of the data input module 12. The computation of 5 times the number of chips entered is stored in memory and is also displayed in the segment 50 of the display module 14. The cash equivalent of the chips is displayed in the segment 52 of the display module 14 as a running total.

The croupier repeats the action for the remaining bets. As each winning total is computed the further number of winning chips is added to the result previously stored in the memory of the data input module 12 at 50 and this cumulative total is also displayed in the segment 52 in $ value.

Should the croupier inadvertently enter incorrect details for a particular bet, then immediately overwriting the incorrect data entry with the correct details reverses the prior entry and its associated running calculations.

After the total win has been calculated and displayed and there is no challenge from the winning player, the winning chips are presented in accordance with the number displayed. The croupier then presses the clear key 20 on the data-input module 12 and dears all segments on the display module 14 and also on the screen 9 of the data input module 12 in readiness for the calculation of the winnings of the next player.

If a previous computation is to be reviewed, pressing the recall key 32 retrieves the computation from the memory of the data input module 12 and is displayed on the screen 28 and on the display module 14.

If a player is betting using cash chips than by coded coloured or numbered chips of a prefixed denomination, then a similar procedure to that described above is followed to determine the appropriate payout In this instance, it is only necessary first to press the appropriate buttons 26*a–h* designating the value of the chips played. The croupier then presses the appropriate bet key 9*a–f* followed by the number of chips placed on that bet Once again, the number of the chips for each bet is displayed on the appropriate subsegments 48*a–f* on the display module 14 and the cumulative number of chips for the player is displayed on the screen 28 of the data input module 12 and the running total is displayed on segment 50 and also on the screen 28 of the data input module 1. The cash equivalent of the chips is displayed in the segment 52 of the display module 14 as a running total.

The process is repeated until all winning players have been presented and a fresh game is to be commenced.

Power for the operation of the calculator can be by battery or mains, AC or DC. The power unit can be integral with said data-input module or remote therefrom. An optional feature is a recall key to recall a bet calculation previously computed. In this embodiment, the clear key also simultaneously stores the calculation to memory for later recall by the recall key.

By using the calculator of the present invention, a number of advantages are available, including assisting the croupier to determine the computation by electronic means rather then manually, thus reducing the possibility of error. As the computation is displayed in a manner which can be viewed by patrons and other staff, particularly the security staff which monitor the gambling tables from a remote location, such monitoring usually being recorded on video, there can be a record of the computation which could assist in settling any dispute that may arise between a patron and a croupier on the bet payout.

In particular the croupier can, with practice, manipulate the keys on the data-input module 12 which is suitably arranged in their line of sight with the table, or at least the display 18 is, so that entries can be checked on entry and winning totals can be viewed for payout without the croupier needing to divert their full attention away from the playing table. For this purpose the data-input module 12 may be a hand held module so that it can be held in the appropriate line of sight position to assist in the croupiers maintenance of control of the game.

It will be appreciated that the above embodiment is given by way of example only and that other modifications and alterations can be made without departing from the inventive concept as defined in the appended claims.

I claim:

1. A method of paying off winning bets in a game of roulette in which players at a roulette table each can place individual bets at different winning odds against a house represented by a croupier, said method including:

(a) providing the croupier with a house input module;

(b) providing a house display positioned for easy viewing by the croupier without diverting his or her attention from the roulette table and the paying off of winning bets placed;

(c) providing a player display;

(d) having the croupier input each winning bet for a particular winning player to a computation device using the house input module;

(e) displaying each winning bet for the particular player input by the croupier on the house display and on the player display;

(f) using the computation device to determine the winnings to be paid by the croupier to a particular winning player as a sum of all payouts due on the winning bets input for the particular winning player;

(g) displaying the winnings for the particular winning player on the house display and the player display along with the display of each winning bet entered for the particular winning player; and (i) repeating steps (d)–(g) for each remaining winning player.

2. The method as claimed in claim 1, further including providing the house input module with keys correlated to different bet types and bet amounts which are manipulated by the croupier to input the winning bets for each of the particular winning players.

3. The method as claimed in claim 1, further including displaying the total number of chips played for each winning bet, the odds of winning per each type of winning bet, and the winnings as chips or as a money value.

4. The method as claimed in claim 3, wherein the step (c) includes the croupier inputting each winning bet by entering numbers of chips corresponding to one or more monetary values that were bet by each particular winning player.

5. The method as claimed in claim 4, further including providing the house input module with player identification keys operated by the croupier for selecting a player color to provide individual player displays of winning input bets and total winnings in different colors on at least the player display for each particular winning player.

6. The method as claimed in claim 3, further including providing the house input module with keys correlated to different bet types and bet amounts which are manipulated by the croupier to input the winning bets for each of the particular winning players.

7. The method as claimed in claim 6, further including paying any peripheral bets placed by returning winning chips directly to peripheral betting stations and excluding peripheral bets from display on the player display.

* * * * *